United States Patent [19]

Drummond

[11] 4,139,199

[45] Feb. 13, 1979

[54] BOARD GAME APPARATUS

[76] Inventor: Gordon E. Drummond, 355 North 200 West, Salt Lake City, Utah 84103

[21] Appl. No.: 853,280

[22] Filed: Nov. 21, 1977

Related U.S. Application Data

[63] Continuation of Ser. No. 656,153, Feb. 9, 1976, abandoned.

[51] Int. Cl.[2] ..... A63F 3/00

[52] U.S. Cl. ..... 273/243; 273/271

[58] Field of Search ..... 273/243, 248, 249, 271, 273/264

[56] References Cited

U.S. PATENT DOCUMENTS

| | | | |
|---|---|---|---|
| 935,755 | 10/1909 | Grundy | 273/264 |
| 2,723,857 | 11/1955 | Miller et al. | 273/243 |
| 2,743,107 | 4/1956 | Hollossy | 273/248 |
| 3,033,572 | 5/1962 | Thibault | 273/243 |
| 3,473,809 | 10/1969 | Day | 273/243 |
| 3,659,851 | 5/1972 | Lang et al. | 273/271 |

FOREIGN PATENT DOCUMENTS

| | | | |
|---|---|---|---|
| 918248 | 10/1946 | France | 273/236 |
| 1244174 | 8/1971 | United Kingdom | 273/243 |

*Primary Examiner*—Richard C. Pinkham
*Assistant Examiner*—Harry G. Strappello
*Attorney, Agent, or Firm*—B. Deon Criddle

[57] ABSTRACT

A game board having a grid thereon; numbers representing possible totals of a pair of dice sequentially designating grid spaces around the outer edges of the board; designated doubles grid spaces adjacent to the outer spaces containing numbers that can be obtained by doubling another number; and a series of central grid spaces that are arranged to be intercepts of other rows of spaces.

13 Claims, 2 Drawing Figures

BOARD GAME APPARATUS

This is a continuation of application Ser. No. 656,153, filed Feb. 9, 1976, now abandoned.

BRIEF DESCRIPTION OF THE INVENTION

1. Field of the Invention

This invention relates to a game board and particularly to such a board for use with dice and playing pieces in the playing of a game of skill and chance.

2. Prior Art

Game boards providing a flat playing surface on which playing pieces are moved according to rules of play and wherein such rules may involve the use of dice to determine movements to be made have long been known. Most such games involve very little skill on the part of the player, but, instead are strictly games of chance.

SUMMARY OF THE INVENTION

Principal objects of the present invention are to provide a game board that can be used to play games involving both chance and a large amount of skill, reasoning and judgement.

Principal features of the board include a grid system with peripheral edge grid spaces including a starting space and sequentially arranged marginal spaces having repeated number sequences therein including all of the numbers that are possible totals resulting from the throw of a pair of dice or that may result from another such chance determination means; designated doubles grid spaces adjacent to the outer spaces containing numbers that can be obtained by doubling another number; and a series of marked central grid spaces that are arranged to be intercepts of grid rows containing at least some of the peripheral edge and/or doubles spaces. In one preferred embodiment the grid is rectangular and the central grid spaces are intercepts of some vertical, horizontal and diagonal rows of spaces.

Additional objects and features of the invention will become apparent from the following detailed description, taken together with the accompanying drawing showing a preferred embodiment of the invention.

THE DRAWING

FIG. 1 is a top plan view of a preferred embodiment of the game board of the invention; and FIG. 2, is a perspective view of typical tokens and dice used with the game board of FIG. 1.

DETAILED DESCRIPTION

Figure 1:
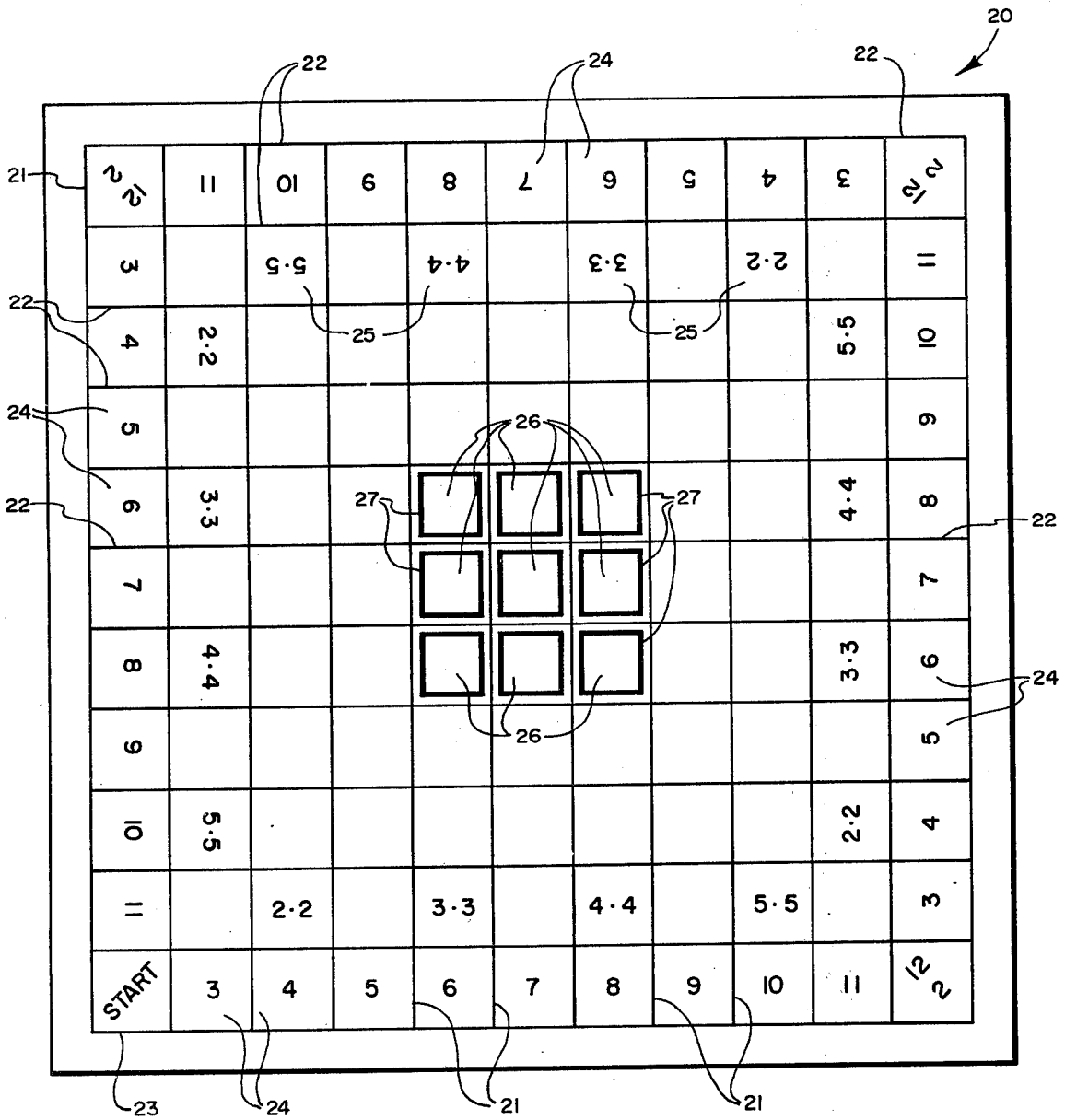
Figure 2:
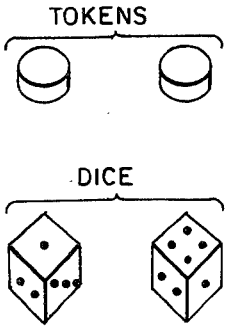

Referring now to the drawing:

In the illustrated preferred embodiment, the game board of the invention, shown generally at 20, is made of cardboard or other suitable flat material. A grid, made up of parallel lines 21 and intersecting parallel lines 22, is formed on a playing face of the board 20, and numbers are placed in certain of the grid spaces, i.e. the spaces bounded by the intersecting parallel lines.

One corner space 23 is designated a starting space and numbers are placed in each of the other marginal spaces 24. As shown, the spaces are numbered in a counterclockwise direction from the starting space, with the marginal edge spaces at one side of the board sequentially numbered 3–11 and the next corner space including both the numbers 2 and 12, that can only be made up from double figures when a pair of dice are used as the chance means for determing play. The same numbering is then repeated in a counterclockwise direction at each side of the board.

A doubles grid space 25 that is adjacent to each of the grid spaces having numbers thereon that can be formed by doubling another number is identified by the doubled number placed twice therein. As will become more apparent the doubles grid spaces provide an alternate space in which a playing piece may be positioned when the game board 20 is used.

A plurality of the central grid spaces 26 are designated by special markings, which in this case are heavy border lines 27 that surround the spaces.

While other games can be played on the game board, in a preferred game, as few as two persons and as many as six persons can conveniently play. In this game a pair of dice are used for change determination and a set of playing pieces (discs, or tokens, for example) is given to each player. Each player has a separately identifiable set of playing pieces. The playing pieces of each set will differ from the playing pieces of each other set by color, size or shape, for example.

PLAYING ON THE BOARD

In playing the game, turn to play rotates left. In his turn, each player rolls the dice and moves one of his playing pieces, i.e. tokens counterclockwise along the marginal numbered spaces 24 to the first vacant space 24 bearing the number indicated by the total of the two dice. If he has no tokens on the numbered spaces 24, he must start one from the start space 23. If he has tokens on the numbered spaces 24, he can move any one of the tokens on the numbered spaces he chooses, or he can start another token from the start space 23. He moves the token he chooses counterclockwise to the first space 24 that bears the number indicated by the dice. If the space is unoccupied, he places his token on it. If the space is occupied by one of his own tokens, he passes over the space and goes on to the next space that bears the indicated number. If the space 24 is occupied by another player's token, he captures the other player's token, removes it from the board and goes on to the next space 24 that bears the indicated number. He moves in this manner from one space that bears the indicated number to the next space that bears the indicated number and then moves again until he comes to one that is unoccupied. He places his token on the unoccupied space.

When a player rolls a dice total of 4, 6, 8 or 10 and it is a double, he moves his token to the first unoccupied space bearing the indicated number. Having rolled a double, he can place his token on either the space 24 bearing the indicated number or its adjoining doubles space 25. If he places it on the doubles space 25, he can move it during any of his turns to play to the adjacent space 24. But a token can never be moved from space 24 to the doubles space 25. There can never be a token on both of the adjacent spaces 24 and 25. If there is a token on one of the two spaces 24 and 25, both spaces are considered to be occupied. The doubles spaces are also treated as numbered spaces and a token on one of them is a token on a numbered space.

When a player rolls a dice total of 4, 6, 8 or 10 that is not a double and in making his move comes to a space 24 bearing the indicated number that has a token on an adjoining doubles space 25, he cannot capture the token on the doubles space 25. He passes over the space and goes on to the next space 24 bearing the indicated number. But if he rolled a double, he captures an opponent's token whether it is on the space 24 bearing the indicated number or on the adjoining doubles space 25 and then moves on to the next space 24 bearing the indicated number.

TO REMOVE TOKENS FROM THE BOARD

If the token being moved by a player reaches the start space 23 before he comes to an unoccupied space 24 that bears the indicated number, he can continue his move along the numbered spaces until he comes to an unoccupied space 24 that bears the indicated number or he can discontinue his move at the start space 23 and remove the token he is moving from the board.

TO TAKE POSSESSION OF THE CENTRAL AREA SPACES

When a player has tokens on two numbered spaces that are in two different diagonals, two different rows or a row and a diagonal (two tokens on opposite ends of the same row or opposite ends of the same diagonal do not qualify) that intersect at one of the nine central area spaces 26, he can, if he so chooses, take possession of that central area space 26 by placing a token on it. He can take possession of a central area space 26 any time he wishes during his turn to play except between the rolling of the dice and making his move for that roll. He can take possession of any number of central area spaces 26 at a time so long as he has tokens properly located on the numbered spaces 24 or 25 to entitle him to possession of each space.

PROTECTION OF POSSESSION OF CENTRAL AREA SPACES

A player's possession of a central area space 26 is protected and cannot be taken from him whenever he has two tokens so located on the numbered spaces that they would entitle him to take possession of the space if he did not already have possession of it. Whenever he does not have two tokens so located on the numbered spaces 24 or 25, his possession of the central area space is unprotected and can be taken from him by anothe player who has two tokens so located on the numbered spaces 24 and 25 that they entitle him to take possession of the central area space 26. The other player, in his turn to play, captures the opposing token, removes it from the board, and places his own token on the central area 26 and thereby takes possession of the space.

EXTRA PLAYS

A player is entitled to another play if he rolls a double; if he captures a token—either on the numbered spaces 24 or 25 or on the central area spaces; if he moves a token to the start space 23 and removes it from the board; or if he places a token on a central area space 26 while he has possession of three central area spaces in a row. Thus, a player may make any number of plays during his turn to play. But, he can be entitled to only one extra play as a result of any one play. For example, if in one play he rolls a double, captures four tokens and removes his token from the board at the start space 23, he is entitled to only one extra play, not six extra plays.

TO WIN THE GAME

To win the game a player must remove all of his tokens on the numbered spaces 24 and 25 from the board by moving them one by one to the start space 23, and, be in possession of three central area spaces 26 in a row—vertically, horizontally or diagonally—when his last token has been removed.

Although a preferred form of my invention has been herein disclosed, it is to be understood that the present disclosure is made by way of example and that variations are possible, without departing from the scope of the hereinafter claimed subject matter, which subject matter I regard as my invention.

I claim:

1. A game apparatus including a game board comprising a flat backing member having
- a flat playing surface thereon;
- said playing surface including
  - a grid forming grid spaces and grid rows on the playing surface;
  - numbers representing all possible numbers that can be obtained with chance selection means sequentially arranged in grid spaces forming a peripheral edge of the grid with one said number in each said grid space forming a peripheral edge of the grid with the exception of a starting space;
  - a starting space in one of said grid spaces forming the peripheral edge;
  - a plurality of marked central grid spaces centrally located within the peripheral edge, each of said marked central grid spaces being intercepts of grid rows containing at least some of the numbered peripheral edge spaces;

a plurality of playing pieces to be positioned on the game board whereby they represent game players; and chance selection means having means thereon for designating numbers corresponding to the numbers arranged in the grid spaces forming the peripheral edge of the grid.

2. A game apparatus as in claim 1, wherein the game board further includes a designated doubles grid space in the grid adjacent to each numbered peripheral edge space containing a number that can be formed by doubling another number.

3. A game apparatus as in claim 1, wherein the numbers in the peripheral edge spaces of the game board are numbers that can be obtained from totalling the numbers showing on the faces of a pair of dice and wherein the chance selection means comprises a pair of dice.

4. A game apparatus as in claim 3, wherein the game board is rectangular and the marked central grid spaces are intercepts of vertical, horizontal and diagonal rows through peripheral edge spaces.

5. A game apparatus as in claim 4, wherein the start space of the game board is at one peripheral corner of the peripheral edge spaces.

6. A game apparatus as in claim 5, wherein the numbers possible from the faces of the dice that can only be obtained as doubles of another number are each placed in each of the peripheral corner spaces other than the start space.

7. A game apparatus including a game board comprising a flat backing member having
- a flat playing surface thereon;
- said playing surface including
  - a grid forming grid spaces and grid rows on the playing surface;
  - numbers representing numbers that can be obtained with chance selection means arranged in grid spaces forming a peripheral edge of the grid;

a plurality of marked central grid spaces located within the peripheral edge, each of said marked central grid spaces being intercepts of grid rows containing at least one of the numbered peripheral edge spaces;

designated doubles grid spaces in the grid adjacent to numbered peripheral edge spaces containing a number that can be formed by doubling another number;

a plurality of playing pieces to be positioned on the game board whereby they represent game players; and chance selection means having means thereon for designating numbers corresponding to the numbers arranged in the grid spaces forming the peripheral edge of the grid.

8. A game apparatus as in claim 7, wherein the numbers in the peripheral edge spaces of the game board are numbers that can be obtained from totalling the numbers showing on the faces of a pair of dice and wherein the chance selection means comprises a pair of dice.

9. A game apparatus as in claim 8, wherein the game board is rectangular and the marked central grid spaces are intercepts of vertical, horizontal and diagonal rows through peripheral edge spaces.

10. A game apparatus as in claim 9, wherein a number possible from the faces of the dice that can only be obtained as the double of another number is placed in at least some of the peripheral corner spaces of the game board.

11. A game apparatus as in claim 10, wherein all numbers possible from the faces of the dice that can only be obtained as doubles of another number are placed in at least some of the peripheral corner spaces of the game board.

12. A game apparatus as in claim 11, wherein a starting space is in one of the grid spaces forming the peripheral edge of the game board.

13. A game apparatus as in claim 12, wherein the starting space is at one peripheral corner of the peripheral edge of the game board.

* * * * *